US009486057B2

(12) United States Patent
Morrow

(10) Patent No.: US 9,486,057 B2
(45) Date of Patent: Nov. 8, 2016

(54) SINGLE-MOULD DEODORANT DISPENSER IN TRAVEL PACKAGE

(71) Applicant: Richard P. Morrow, Norwalk, CT (US)

(72) Inventor: Richard P. Morrow, Norwalk, CT (US)

( * ) Notice: Subject to any disclaimer, the term of this patent is extended or adjusted under 35 U.S.C. 154(b) by 61 days.

(21) Appl. No.: 14/103,793

(22) Filed: Dec. 11, 2013

(65) Prior Publication Data

US 2014/0140750 A1 May 22, 2014

Related U.S. Application Data

(63) Continuation-in-part of application No. 13/427,854, filed on Mar. 22, 2012, now Pat. No. 8,894,314.

(51) Int. Cl.

| | |
|---|---|
| ***A45D 40/26*** | (2006.01) |
| *A45D 40/00* | (2006.01) |
| *A45D 40/28* | (2006.01) |

(52) U.S. Cl.

CPC ..... *A45D 40/26* (2013.01); *A45D 40/0087* (2013.01); *A45D 40/28* (2013.01); *A45D 2040/0012* (2013.01)

(58) Field of Classification Search

CPC ..... A45D 2040/0012
USPC ..... 401/8, 54, 261, 266; 16/255
See application file for complete search history.

(56) References Cited

U.S. PATENT DOCUMENTS

| | | | | |
|---|---|---|---|---|
| 2,664,581 | A * | 1/1954 | Miller et al. | 132/307 |
| 3,124,824 | A * | 3/1964 | Lutz | 15/227 |
| 4,014,616 | A * | 3/1977 | Mast et al. | 401/292 |
| 4,893,956 | A * | 1/1990 | Wojcik et al. | 401/130 |
| 4,994,049 | A * | 2/1991 | Latzke et al. | 604/307 |
| 5,027,467 | A * | 7/1991 | Tarrson et al. | 15/167.1 |
| 5,771,522 | A * | 6/1998 | Carmody | 15/208 |
| 6,196,747 | B1 * | 3/2001 | Kreiseder et al. | 401/266 |
| 6,406,206 | B1 * | 6/2002 | Girardot et al. | 401/264 |
| 6,528,154 | B1 * | 3/2003 | Yamato | 428/317.9 |
| 7,416,358 | B2 * | 8/2008 | Legendre | 401/205 |
| 7,674,058 | B2 * | 3/2010 | Berger Sharp et al. | 401/7 |
| 7,927,034 | B2 * | 4/2011 | Staniforth et al. | 401/262 |
| 8,272,801 | B2 * | 9/2012 | Linzell | 401/261 |
| 8,393,043 | B2 * | 3/2013 | Limongi et al. | 15/209.1 |
| 2001/0048841 | A1 * | 12/2001 | Girardot et al. | 401/266 |
| 2003/0095827 | A1 * | 5/2003 | Ruschke et al. | 401/266 |
| 2008/0004648 | A1 * | 1/2008 | Hohlbein et al. | 606/161 |
| 2012/0128399 | A1 * | 5/2012 | Limongi et al. | 401/8 |

* cited by examiner

*Primary Examiner* — Jennifer C Chiang
*Assistant Examiner* — Joshua Wiljanen
(74) *Attorney, Agent, or Firm* — Handal & Morofsky, LLC

(57) ABSTRACT

A device for the application of a gel or solid substance to a human body surface is disclosed. The apparatus is comprised of an applicator portion to which gel or solid deodorant is secured and which is coupled to a handle portion. The applicator portion is sized to accommodate a single application of deodorant in a compact format while the handle portion is sized to be grasped between the fingers and thumb of the human hand. The handle portion comprises a moveable connecting point allowing the handle portion to traverse between a storage position and a gripping position during use. The applicator portion is integrally formed with said handle portion.

27 Claims, 22 Drawing Sheets

SINGLE-MOULD DEODORANT DISPENSER IN TRAVEL PACKAGE

CROSS REFERENCE TO RELATED APPLICATIONS

This application is a continuation-in-part of U.S. patent application Ser. No. 13/427,854 filed Mar. 22, 2012, the disclosure of which is hereby incorporated by reference thereto.

TECHNICAL FIELD

The invention relates to apparatus and methods for the delivery of deodorant to the surface of the skin of a human user.

STATEMENT REGARDING FEDERALLY SPONSORED RESEARCH OR DEVELOPMENT (Not applicable)

BACKGROUND OF THE INVENTION

Today, people are exceedingly busy in attending to business matters and often have to rush between multiple appointments. Often, this does not leave much time for the luxury of returning home to freshen up. Accordingly, such products are of increasing importance.

Additionally, a high-paced, mobile lifestyle, involving such things as airline flights, road trips and the like, does not lend itself well to carrying large hygiene product containers, such as a conventional deodorant product, which can open, and under certain circumstances, spill while they are inside bags and briefcases. Therefore, a need exists for a small, single use deodorant applicator which can be easily concealed, even in a small pocket, yet safe for transport due to an individually sealed, portable design.

SUMMARY OF THE INVENTION

In accordance with the invention, an apparatus for the delivery of deodorant to the surface of the human body is provided. It comprises an applicator portion to which is secured a gel or solid deodorant and which is coupled to a handle portion. The applicator portion is sized to accommodate a single application of deodorant in a compact format while the handle portion is sized to be grasped between the fingers and thumb of a human hand. The handle portion comprises a flexible connecting point allowing the handle portion to traverse between a storage position and a gripping position during use.

The invention comprises an apparatus for the application of a gel or solid deodorant substance to the surface of a human body. In accordance with the invention, a base comprises an applicator portion. The applicator portion has a deodorant support side, a gripping portion, and a deodorant substance secured to the applicator portion of the base. The base and deodorant substance form the applicator and an enclosure defining a compartment houses the base and the deodorant substance.

The applicator portion of the base comprises a matrix of recesses to which the deodorant substance is affixed. The matrix of recesses defines an array of narrow elongated contours at least some of which extend at least partially around one or more of others of the narrow elongated contours. Each of the narrow elongated contours defines a recess defined by facing sidewalls which extend at an angle with respect to the deodorant support side and face the sidewalls engaging the deodorant substance. The handle is coupled to the gripping portion of the base. The enclosure comprises a plastic film. The handle comprises a rigid grip dimensioned to be grasped between the fingers and thumb of a human hand. A mounting member coupled to the base and rotatably supporting the rigid grip enables the rigid grip to move between a storage position and a gripping position. The mounting member of the apparatus is mounted on the base by mounting pins allowing the flexible mounting member to rotate around the mounting pins in an arc.

The handle of the apparatus may comprise a cloth member comprising a gripping end protruding from the gripping portion of the base and dimensioned to be grasped between the fingers and thumb of a human hand and a mounting end coupled to the gripping portion of the base.

The handle may also comprise two gripping members protruding from the base. The gripping members define a finger hole passing through the gripping member. The hole is sized to allow a finger or thumb of a human hand to be inserted within the finger hole. The gripping members comprise a flexible mounting member coupled to the base which allow the gripping members to traverse between a storage position and a gripping position. The base and handle are made of plastic injection molded from a single piece of plastic.

The handle may also be formed integrally with the base of the invention to form a living hinge. The living hinge allows for the handle to fold flat, planar to the base, for packaging. Upon opening the package, the user can grab the handle and bend it outward such that the handle becomes perpendicular to the base. This gives the user a graspable handle and controllable applicator to direct and apply the deodorant of the invention to the body of the user. The inventive package may also be made in a single injection moulding step.

BRIEF DESCRIPTION THE DRAWINGS

The operation of the invention will become apparent from the following description taken in conjunction with the drawings, in which:

FIG. 1*a* is a side view outlining the basic elements of the invention in which the applicator portion and handle portion may be understood;

FIG. 1*b* is a cross-sectional view of the support base and supported deodorant material along lines 1*b*-1*b* of FIG. 3 corresponding to a cross-sectional view defined by the intersection of a plane perpendicular to the plane roughly defined by the support and a plane perpendicular to and passing through the center of the support;

DETAILED DESCRIPTION OF THE PREFERRED EMBODIMENTS

Figure 1A:
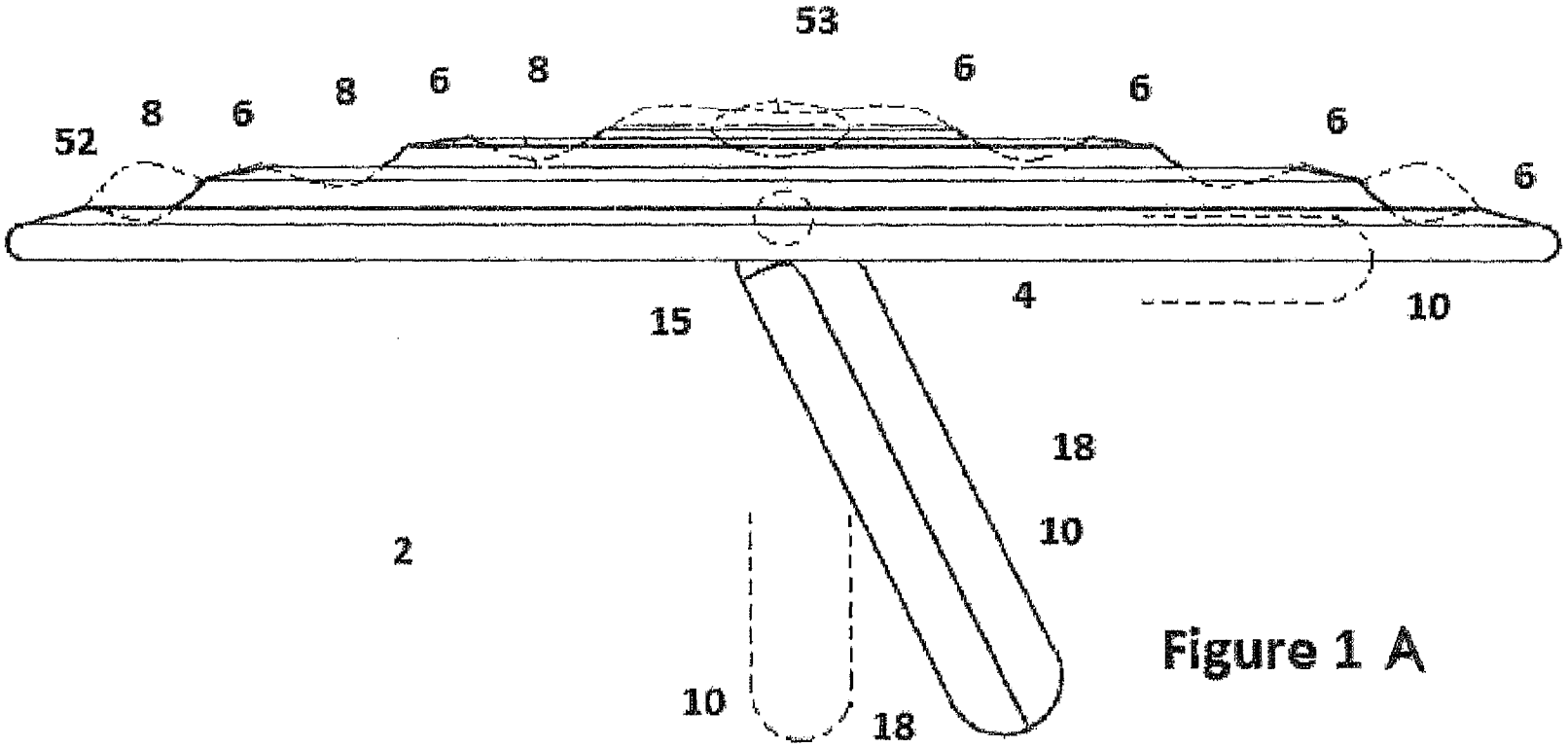

Referring to FIG. 1*a*, an overview of a single-use deodorant applicator may be understood. The single-use deodorant applicator 2 comprises a circular base 4 composed of plastic in accordance with a preferred embodiment, or, alternatively, metal. Base 4 is rigid and functions as a foundation upon which the rest of the device is constructed. The top of circular base 4 comprises a series of raised rings 6 as well as corresponding circular channels 8. Raised rings 6 and circular channels 8 are shaped and spaced in such a way that deodorant, in either gel or solid form, can be affixed to base 4 with the deodorant utilizing raised rings 6 and circular channels 8 as an adherence surface. A plastic or metal handle 10 is coupled to the underside of base 4 such that handle 10 can swivel out from a position lying flat against base 4 (as illustrated in phantom lines), to a position perpendicular or nearly perpendicular to the bottom surface of base 4 for use, or swivel in, parallel to the bottom surface of base 4 for storage.

Figure 1B:
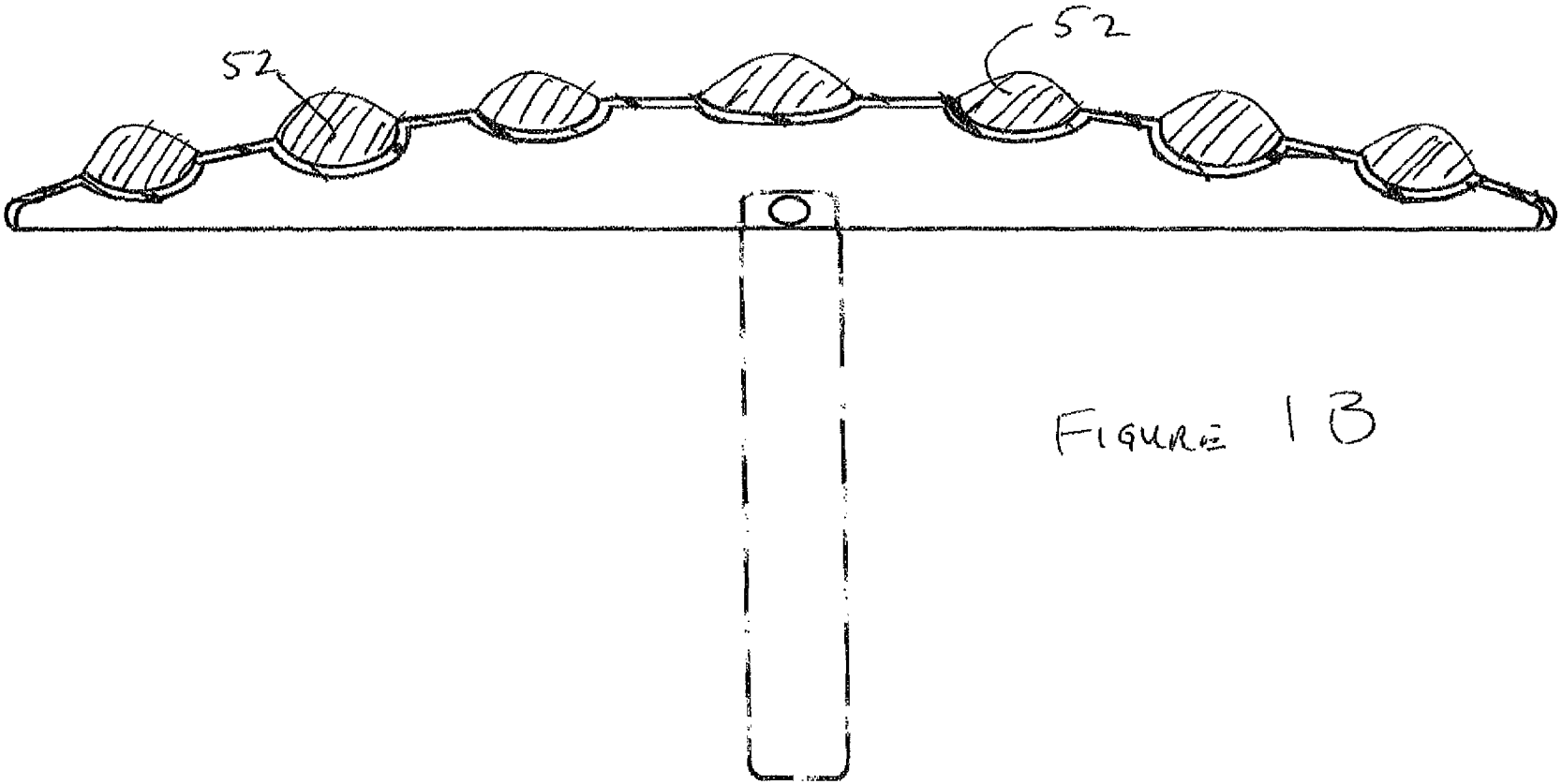

FIG. 1*b* illustrates the placement of deodorant material 52 in channels 8 in the form of rings of deodorant material. It will be understood from the figures that successive rings are positioned at different heights from the bottom of base 4. The outermost rings of deodorant material 52 are relatively low and the central deposition of deodorant material 53 is in the highest position. Accordingly, together rings of deodorant material 52 and the central circular deposition of deodorant material 53 generally defined a convex or domed configuration.

Figure 2:
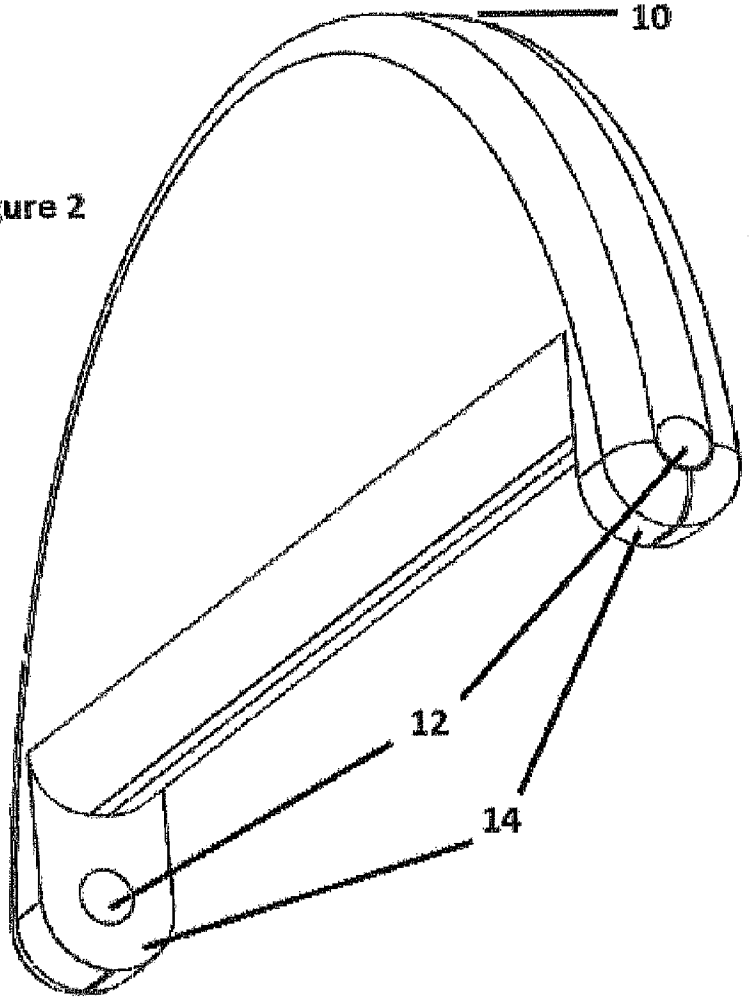
FIG. 2 is a diagram of a rigid handle system embodiment of a handle portion of the invention.

Referring to FIG. 2, the construction of handle 10, and how handle 10 attaches to base 4, may be better understood. Handle 10 is constructed in a semi-circular shape. Handle 10 made sized such that it can fold back against base 4 without protruding. Two mounting holes 12 pass completely through mounting arms 14, which extend past base 4 on either side of the attaching end of handle 10. The mounting arms 14 and handle 10 are formed in a single injection molded plastic member, adding strength and simplicity to the design. The mounting holes 12 allow the handle 10 to be attached to base 4 of the single-use deodorant applicator through the use of mounting pins 15 (FIG. 1*b*), which will be described in greater detail below.

Figure 3:
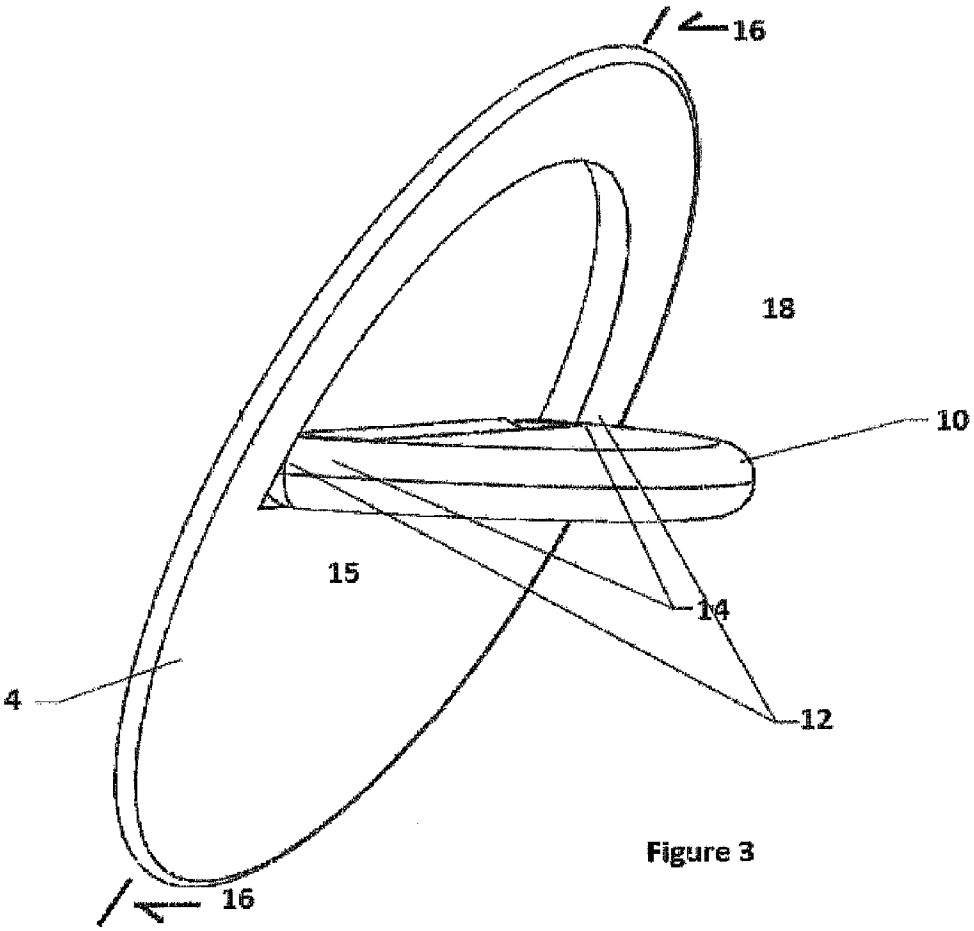
FIG. 3 is a diagram of a coupling system comprising a rigid handle system and the base of the applicator portion of the invention.

Referring to FIG. 3, a connection assembly attaching handle 10 to base 4 may be understood in greater detail. The handle 10 connects to base 4 such that handle 10 can be quickly snapped into place during component assembly. The component assembly process involves aligning mounting arms 14 of handle 10 perpendicular to the bottom of base 4 such that mounting holes 12 of mounting arms 14 are positioned just below a pair of mounting pins 15 protruding from base 4. The mounting pins 16 protrude from base 4 such that they are always in line with holes 12 in mounting arms 14, when properly mounted inside mounting holes 12. The mounting pins 15 are positioned such that it is possible for handle 10 to traverse a semi-circular are defined in the direction of arrows 18, thus allowing the orientation of handle 10 to traverse such arc from a flat starting position against the bottom of base 4 to a finishing position which is perpendicular to the bottom of base 4. Deodorant material 52 of conventional design is deposited in circular channels 8.

Figure 4:
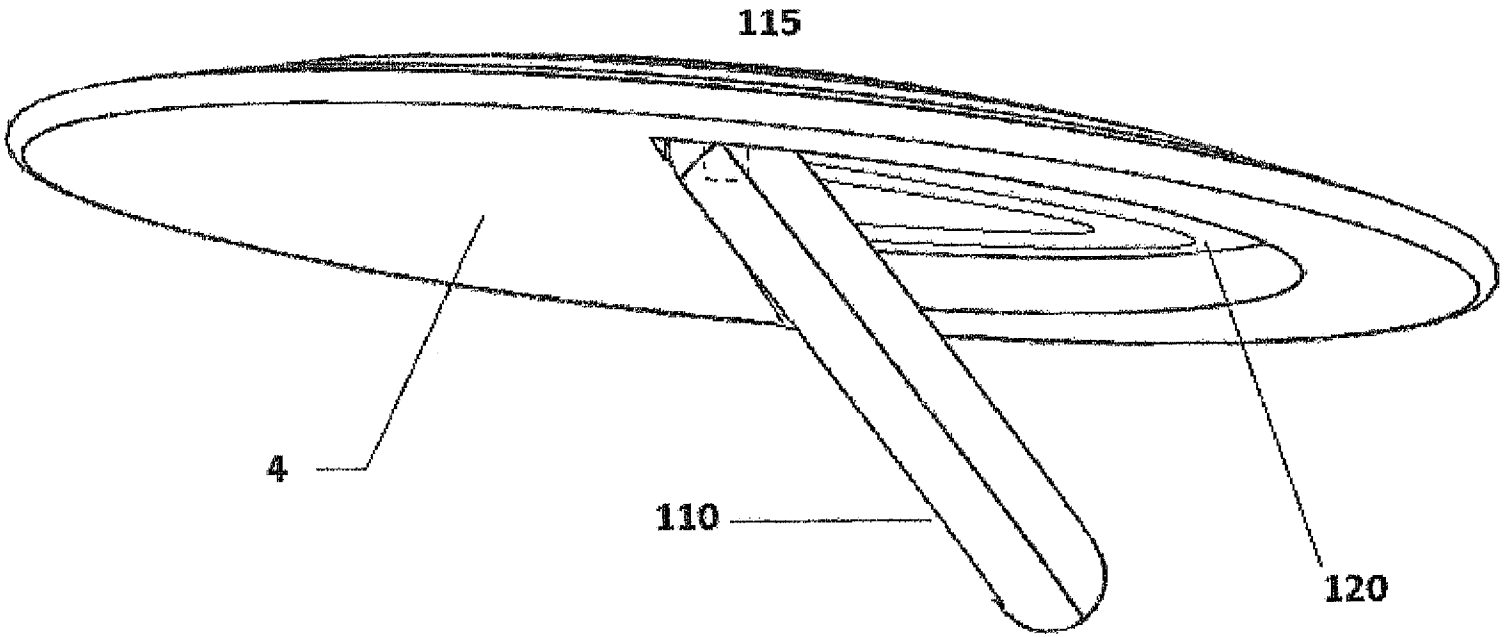
FIG. 4 is a diagram of an alternate mounting method of a rigid handle system coupled to the base of the applicator portion of the invention.

Referring to FIG. 4, an alternate mounting method for handle 110 may be understood. Once again, handle 10 is attached to base 4 through the connection of mounting pins 16 in mounting holes 12 which are located at the ends of mounting arms 14. The handle 10 is mounted such that mounting arms 14 are always perpendicular to mounting pins 115, thus allowing the orientation of handle 110 to traverse in an arc from a flat position against base 4 to an extended position which is perpendicular to base 4. The mounting pins 115 are coupled to base 4 and are located inside a recess 20 on the bottom of base 4, thus allowing handle 10 to fold inside base 4 for compact storage with minimal or no protrusion from base 4. The recess 120 is shaped to match the shape of handle 10 such that handle 10 fits snugly inside recess 120 without sticking such that handle 10 may be easily extended along the arc defined by the movement of handle 10, as it may be moved by the use of, for example, a human finger.

Figure 5:
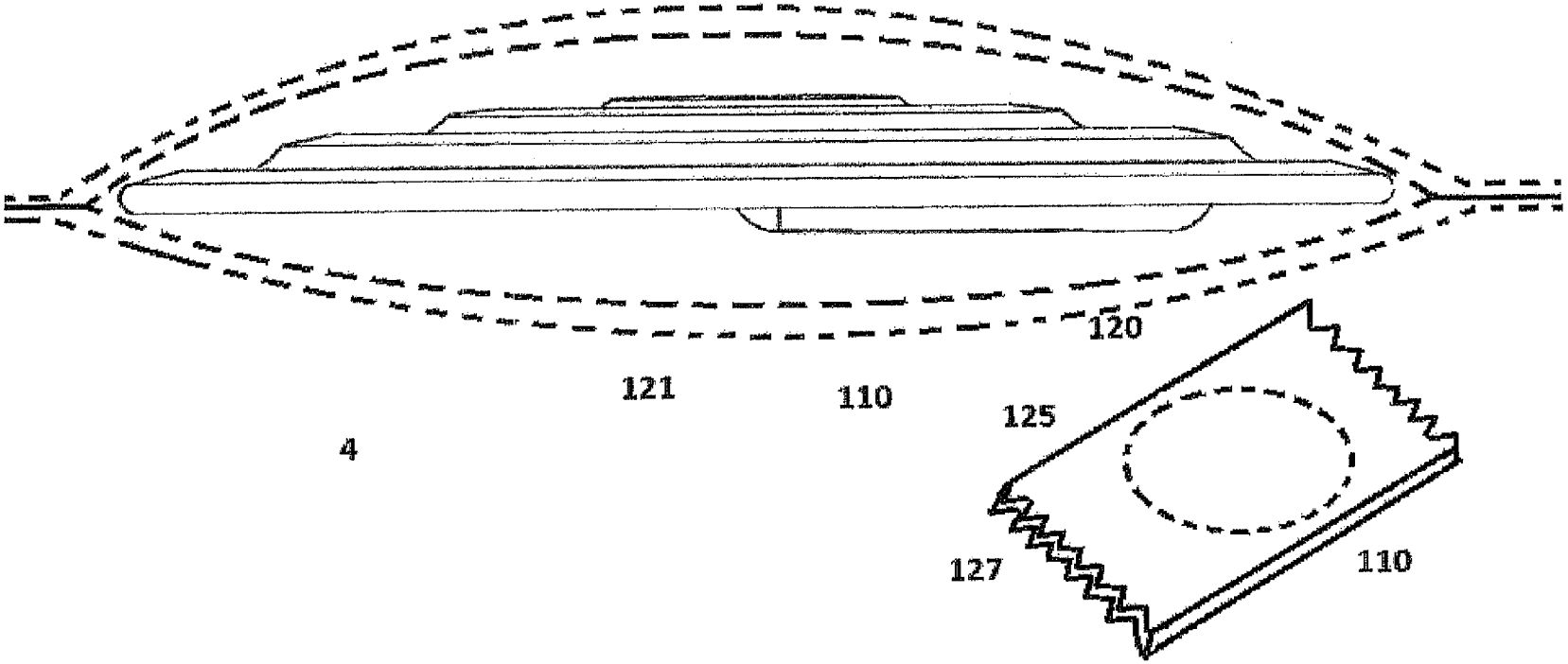
FIG. 5 is a diagram of a possible storage configuration for the invention in which a rigid handle system is stowed into a recess in the underside of the base of the applicator portion of the invention.

Referring to FIG. 5, it may be understood how handle 10 fits snugly inside recession 120 of base 4 when handle 10 is in a closed position. In this diagram, it is shown how handle 110 protrudes slightly from recess 20 in the bottom of base 4 such that a finger may make easier contact with handle 110. The configuration diagramed in FIG. 5 allows for a larger contact surface between handle 110 and a human finger while still providing a thin profile for compact storage. If no protrusion is desired, handle 10 they been made thinner.

Also referring to FIG. 5, an optional storage packet may be used to contain the apparatus. Such storage packets may be a conventional form, for example, similar to those used to house condiments such as ketchup and mustard. In accordance with the invention, such a storage packet may be formed in a conventional manner, for example being formed by a pair of facing planar film members. More particularly, a container may be formed by a planar bottom layer 121 and a planar top layer 123. Planar bottom layer 121 and planar top layer 123 may be made of a polymer, such as a simple plastic film as is used to house ketchup. Alternatively, metallized polymer layers may also be employed. In accordance with the invention, it is contemplated that planar bottom layer 121 and planar top layer 123 would have a thickness in the range of 2-7 thousandths of an inch.

In the case of a simple polymer layer of the type used to house ketchup in individual single servings, planar bottom layer 121 and a planar top layer 123 may be formed into a packet by being heat-sealed around their edges 125 (FIG. 5*a*). As is apparent from the figures, planar bottom layer 121 and planar top layer 123 are substantially the same size and larger than the inventive applicator 110. Accordingly, planar bottom layer 121 and planar top layer 123 extend beyond the edge of both the length and width of the applicator 110. The peripheral portions of planar bottom layer 121 and a planar top layer 123 are fused together, for example, using heat around the edge of the apparatus to form an airtight, single-use container similar to a ketchup packet. The result is a sealed unit 125 containing applicator 110. Sealed unit 125 includes serrations 127 in a manner typical of such packets.

It is noted that while the use of such a package is illustrated only in FIG. 5, it may be understood this packet can be used to house any of the other variations of the inventive apparatus as illustrated in the figures herein.

In accordance with the invention, it is contemplated that a plurality of applicators 110 would be contained each in its own container 123, perhaps packaged in a larger box containing a half-dozen or several dozen packaged applicators. When it is desired to use one of these devices to apply deodorant, the package is split between the serrations 127 using the fingernails, torn open and the deodorant applicator 110 is removed and used as described herein.

Figure 6:
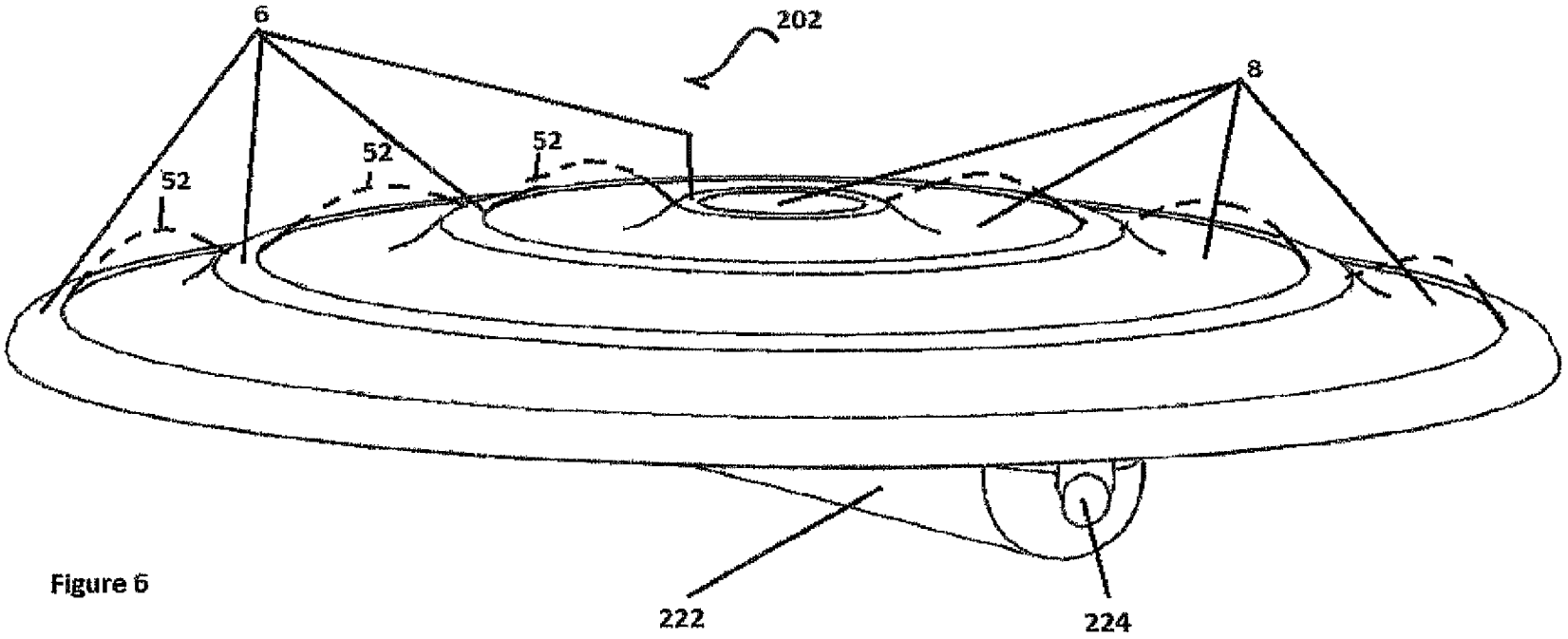
FIG. 6 is a diagram of an alternate mounting configuration for a handle portion of the invention.

Referring to FIG. 6, an alternate mounting configuration for handle 10 may be understood. A cylindrical mounting protrusion 222 extends from the bottom of base 4 such that it is possible to align mounting holes 12 of mounting arms 14 with mounting pin 224 of mounting protrusion 222. The mounting pin 224 along the length of mounting protrusion 222, perpendicular to the circular faces of the cylinder and, therefore, parallel to the bottom of the base 4. When the mounting holes 12 of the mounting arms 14 are properly aligned with the mounting hole 14 of the mounting protrusion 222, handle 10 rotates on pins 224 Thus, handle 10 may easily be snapped into place, similar to the process described with respect to FIG. 3, and may further rotate freely after being snapped into place.

Also referring to FIG. 6, the circular ring system of ridges and channels involved in the mounting of gel or solid deodorant may be understood. The raised rings 6 and circular channels 8 are all formed from the same plastic member that comprises base 4 during the fabrication process of, for example, injection molding. Furthermore, the mounting protrusion 222 can be formed from the same plastic mold as well during the fabrication process with the mounting pin 224 B. As a result of the fabrication process, the raised circular rings 6 and circular channels 8 form a mounting surface for a gel or solid deodorant 52 such that the tops of the channels 8 are nearly slanted extending from but not quite perpendicular to the base 4, thus providing sufficient friction to hold a gel or solid deodorant in place. Because the inner rings 6 and channels 8 protrude higher from the base 4 than the outer rings 6 and channels 8, it is possible for the single-use deodorant applicator 202 to conform to various human body surfaces more easily.

Figure 7:
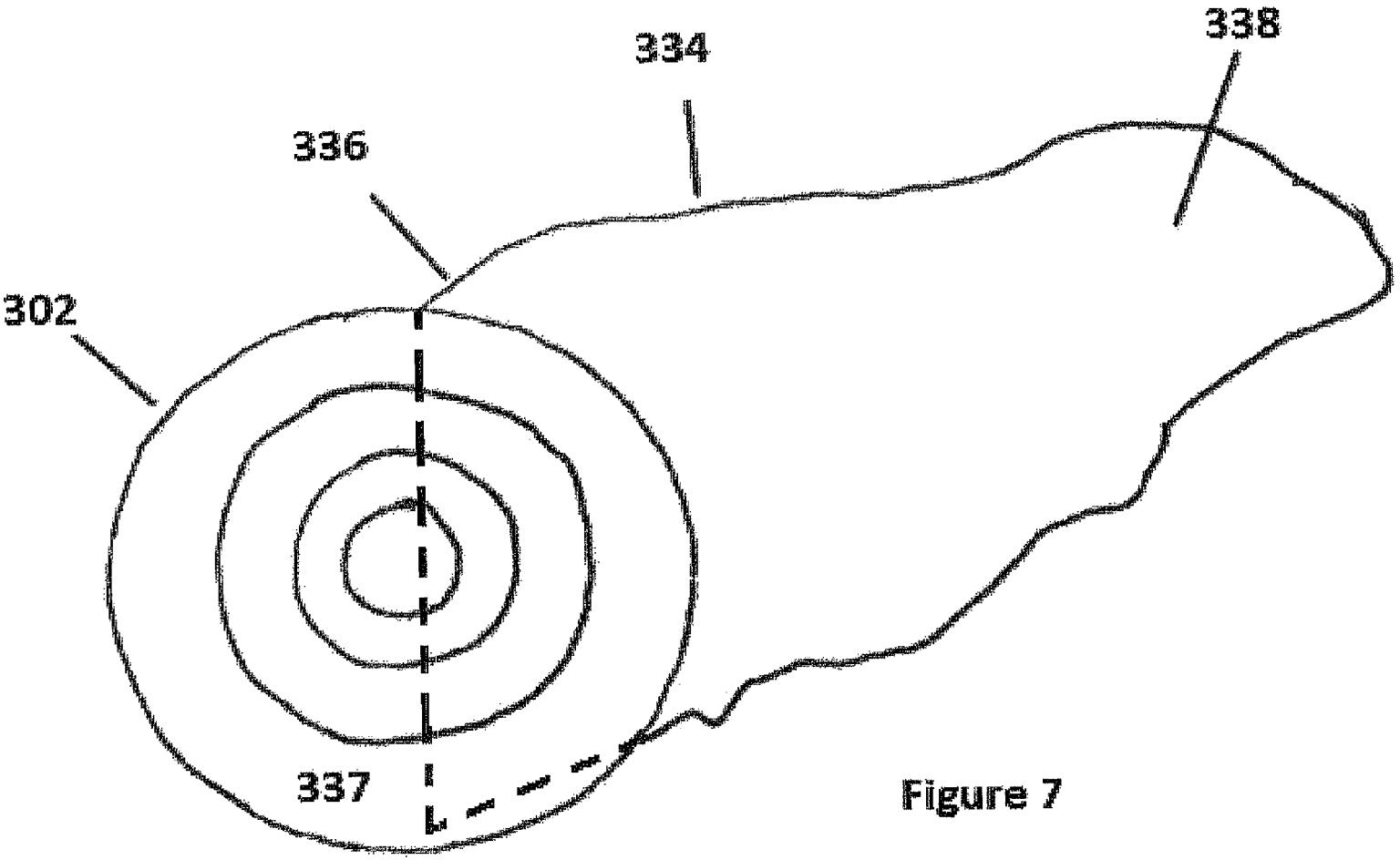
FIG. 7 is a diagram of another alternate cloth handle portion of the invention.

Referring to FIG. 7, an alternate handle system 334 may be understood. In this alternate handle system, a flexible or semi-rigid handle 34 is cut to shape from a sheet of cloth or plastic. The handle 334 comprises an attachment end 336 on one side and a gripping end 338 on the other side. The attachment end 336 is affixed along a joinder line 337 to the bottom of the single-use deodorant applicator 302 using some form of adhesive such as glue or tape. The gripping end 338 protrudes from the side of the single-use deodorant applicator 302 to a sufficient distance such that the gripping end 338 may be easily grasped by the fingers of a human hand. The handle 334 is sufficiently thin to allow for compact packaging. Accordingly handle 334 can be folded behind the single-use deodorant applicator 302 for compact packaging.

Figure 8:
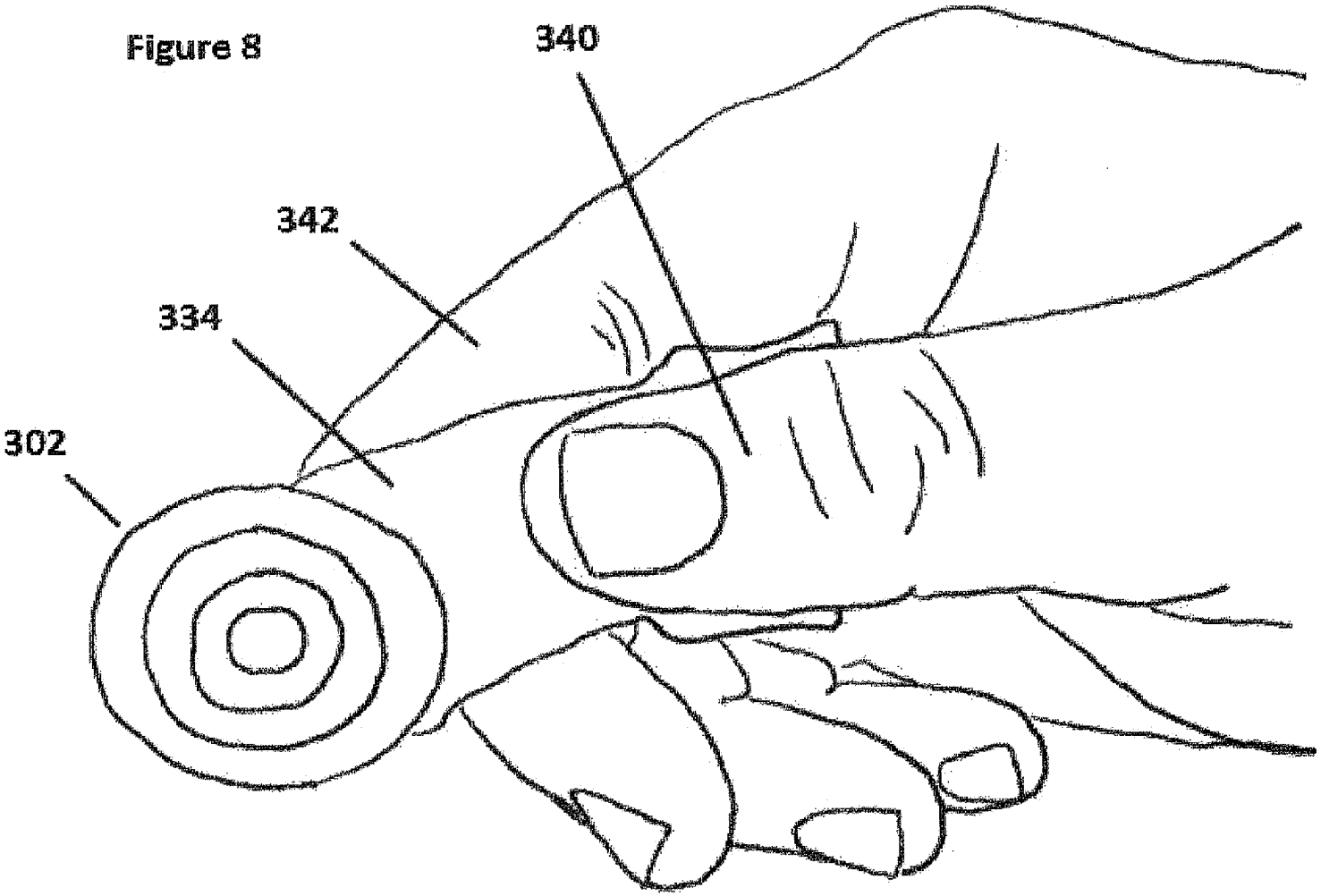
FIG. 8 illustrates the use of the above mentioned alternate cloth handle portion of the invention.

Referring to FIG. 8, the use of the alternate handle system 334 may be understood. As mentioned above, the gripping end 338 of the handle 334 protrudes from the side of the single-use deodorant applicator 302. This allows the fingers of a human hand to easily grasp the handle 334 between them with thumb 340 pressing against the top side of handle 334 and finger 342 pressing against the bottom side of handle 334. This method allows finger 342 to act as a guide for the single-use deodorant applicator 302 while deodorant is being applied to the human body by providing moderate pressure to rub the top surface of the single-use deodorant applicator 302 against the skin surface to which the user wishes to apply deodorant.

Figure 9:
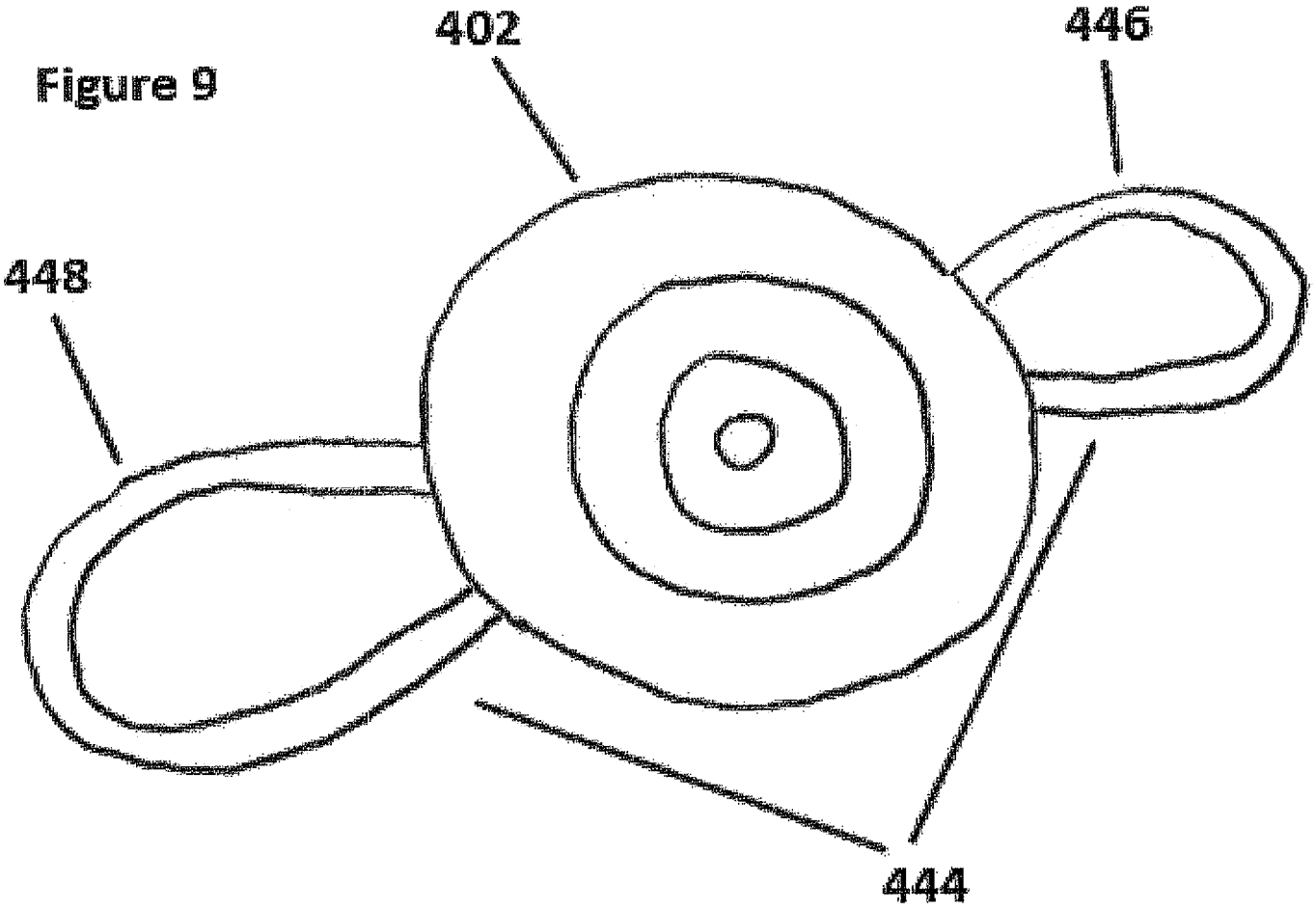
FIG. 9 is a diagram of yet another alternate handle portion comprising a pair of loops.

Referring to FIG. 9, an alternate handle system 444 may be understood. The handle system 444 comprises two plastic loops, loop 446 and loop 448, which are made from the same plastic material of which the single-use deodorant applicator 402 is made. This means that no special attachment system is required. Instead, the handle system 444 is formed at the same time as the single-use deodorant applicator 402 in a single molding or stamping process. This eliminates the need for complicated manual assembly while allowing for many instances of the single-use deodorant applicator 402 to be created simultaneously, in accordance with the manufacturing process to be described below. Loop 446 and loop 448 are flexible enough to be bent backwards below the base of the single-use deodorant applicator 402 for gripping by the thumb and finger of a human hand during use.

Figure 10:
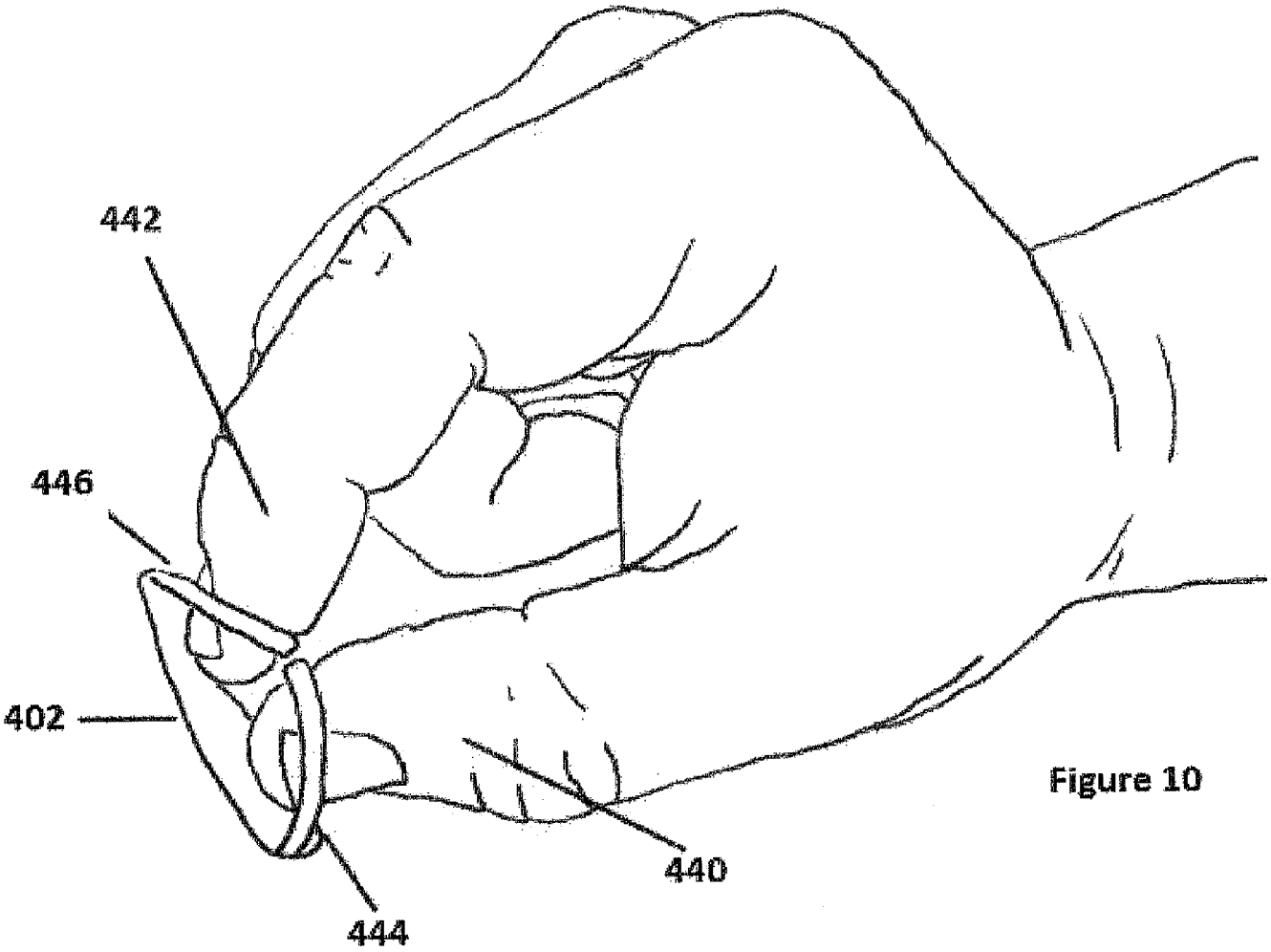
FIG. 10 shows the use of the above mentioned alternate handle portion comprising a pair of loops.

Referring to FIG. 10, the use of the alternate handle system 444 may be understood. The single-use deodorant applicator 402 is gripped by folding loop 446 and loop 448 backwards below the base of the single-use deodorant applicator 402. The thumb 440 is then inserted into the loop 446 while the finger 442 is inserted into the loop 448. The thumb 440 and the finger 442 are then pinched together, thus creating enough tension and friction to hold the single-use deodorant applicator 402 in place and allow for controlled movement during deodorant application to a human body during use.

Figure 11:
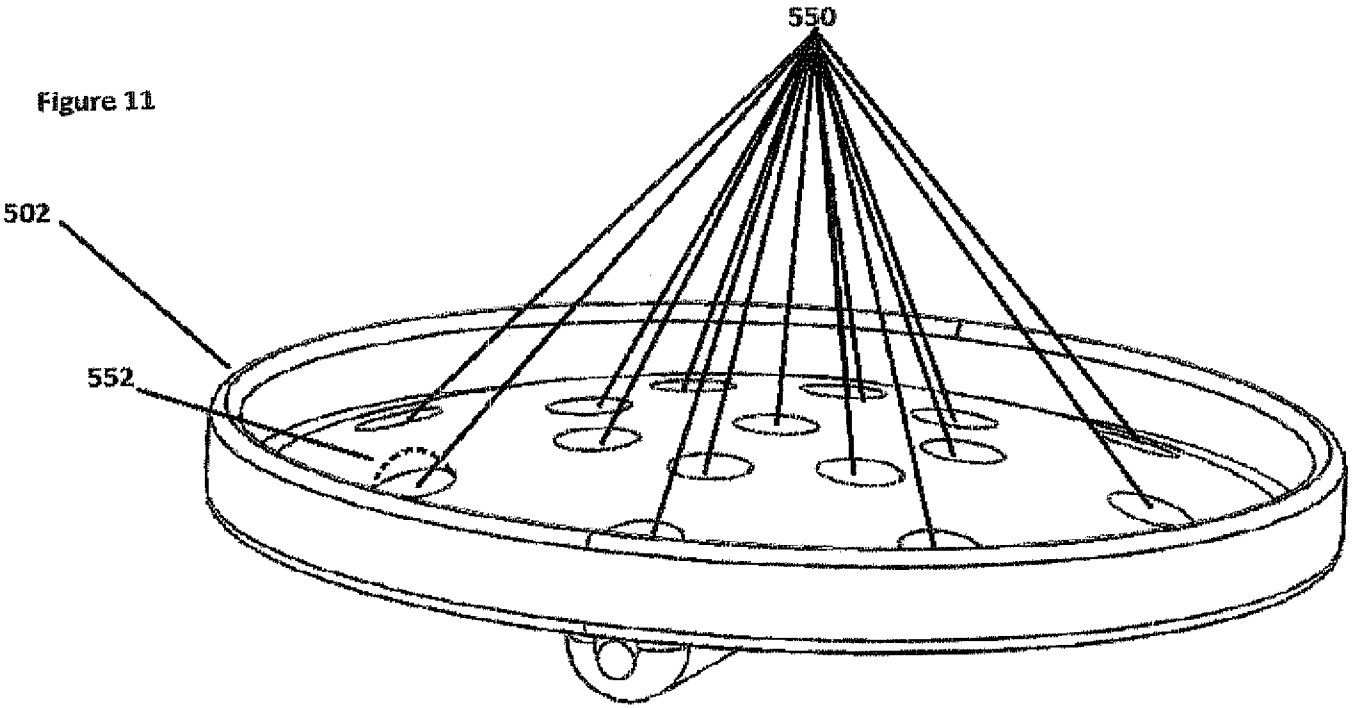
FIG. 11 is a diagram of an array of indentions across the application surface of applicator portion of the invention.

Referring to FIG. 11, a method for securing deodorant in a gel or solid form may be understood. A series of indentations 550 are distributed over the surface area of the single-use deodorant applicator 502 in which deodorant 552 in a gel or solid form may be inserted. The indentations are deep enough to provide a sufficient anchor for the deodorant.

Figure 12:
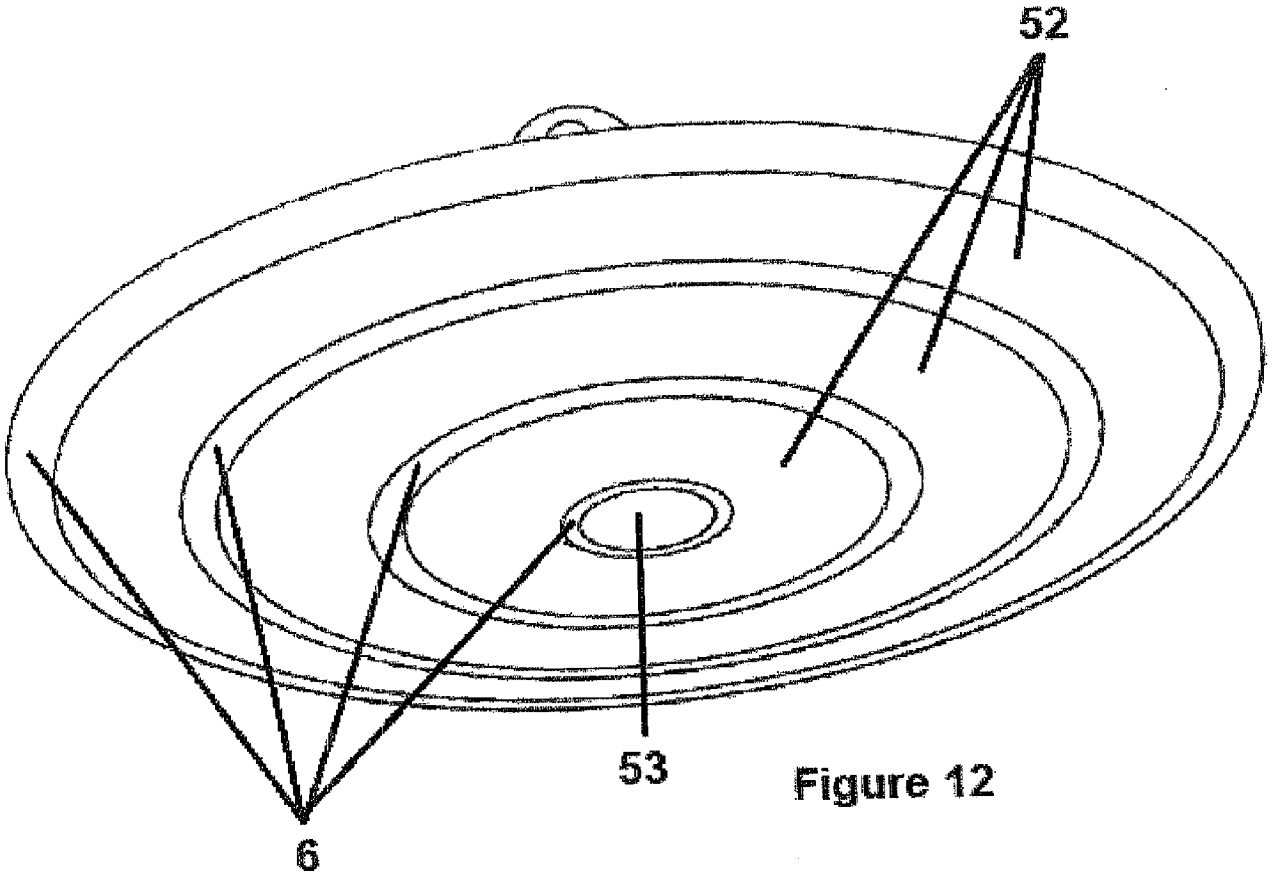
FIG. 12 is a diagram of rings of deodorant anchored between an array of raised rings on the applicator surface of the applicator portion of the invention.

Referring to FIG. 12, the anchoring of a gel or solid deodorant 52 within an array of raised rings 6 may be understood. The deodorant 52 is applied between each of the raised rings 6 such that the deodorant 52 protrudes slightly above the upper surface of the raised rings 6. During the application process, the deodorant 52 will transfer to a contacted human skin surface. Since the human skin surface is flexible, the skin can be pressed in between the raised rings 6, during application, as the vertical height of the deodorant 52 is reduced during use.

Figure 13:
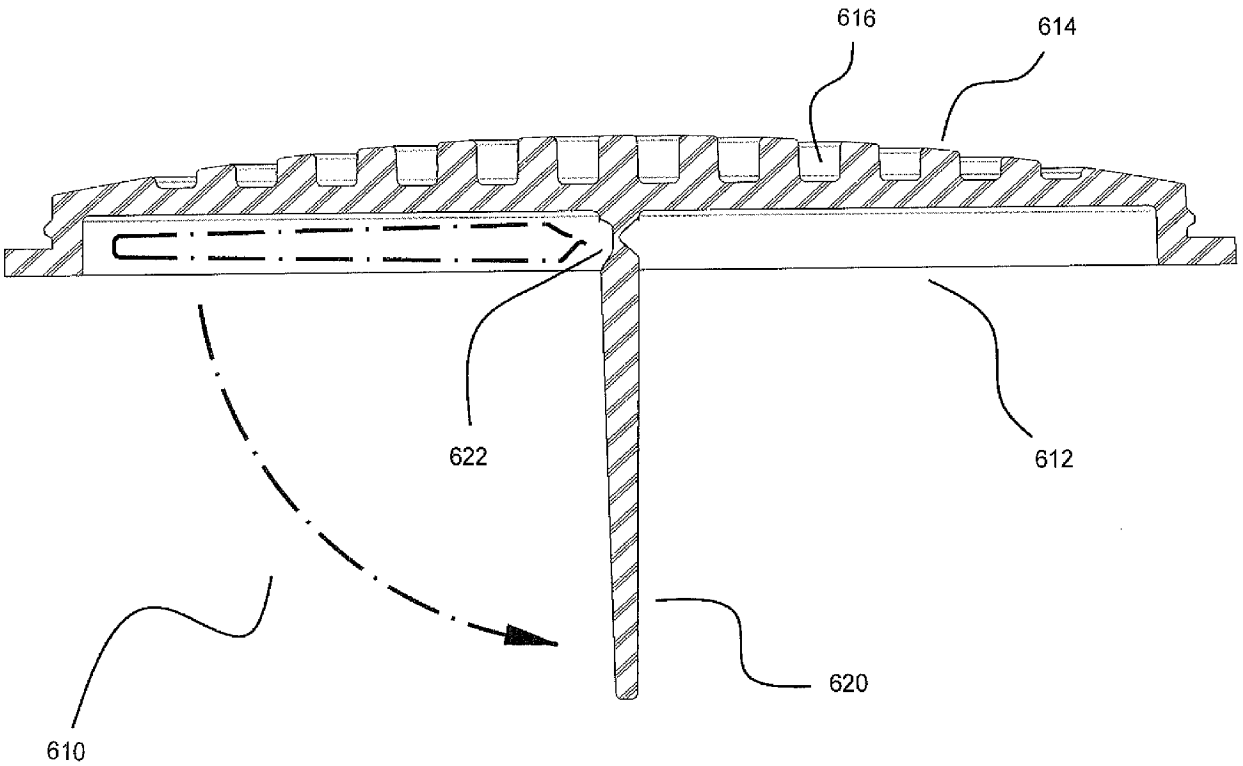
FIG. 13 is a sectional side-view of a living hinge embodiment of the applicator of the present invention with the grasping handle illustrated in solid lines with the handle moved in the direction of the arrow to in the use position, and in phantom lines with the handle him the folded storage position.

Referring to FIG. 13, a sectional side-view of an alternative embodiment of the deodorant applicator 610 is shown. In accordance with the invention, it is noted that applicator 610 is manufactured in the configuration illustrated in solid lines in FIG. 13. After the same is manufactured, handle 620 is folded to the position illustrated in phantom lines after which the same may be packaged in a flat envelope like container. In use, after removal of applicator 610 from the package, handle 620 is pulled from the position illustrated in phantom lines in FIG. 13 to the position illustrated in solid lines.

Handle 620 is formed integrally with base 612 and a living hinge 622, which joins the handle to base 612. The living hinge 622 allows for the handle 620 to be folded up into the base 612 for packaging. When the user opens the package to use the deodorant applicator, the user can fold the handle 620 out of the base 612, such that the handle 620 is substantially perpendicular to the base 612, allowing the user to grasp the handle 620 and use the deodorant applicator 610. The living hinge is a more cost-effective and efficient option.

The figure also shows the raised rings 614 and corresponding circular channels 616. Raised rings 614 and circular channels 616 are shaped and spaced in such a way that deodorant can be affixed to base 612 with the deodorant utilizing raised rings 614 and circular channels 616 as an adherence surface.

The dimension of the largest rings may be in the range of about one and three-quarter inches in diameter, or about 4 centimeters. The height of the applicator may be about 0.3 inches or about 7 mm. The height of the deodorant may have a total thickness of about 3.5 mm, or about 2.5 mm in the circular channels and about 1 mm over the top of the ridge.

Figure 14:
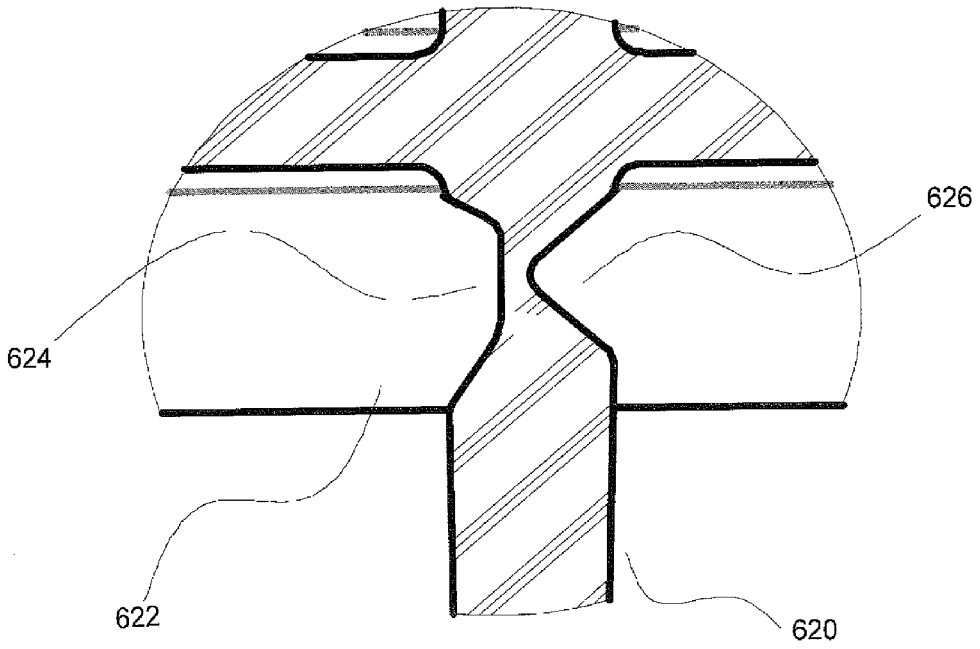
FIG. 14 is an enlarged view of the living hinge.

FIG. 14 is an enlarged view of the living hinge 622. A first surface 624 is defined on the living hinge 622. The first surface 624 has a first width. A second surface 626 is defined on the living hinge 622, directly opposite the first surface 624. The second surface 626 has a second width, which is narrower than the first width. The first width is larger to better allow the handle 620 to be bent at the living hinge 622 towards the base 612 on the side of the first surface 624. The lack of material in the location of the first surface 624 provides for the adjacent portions of the living hinge 622 and handle 620 to be compressed as the handle 620 is being folded in towards the base 612 in the direction opposite that of the arrow in FIG. 13. The narrower, second width is present in order to allow the handle 620 to fold, towards the first surface 624, in to the base 612.

Figure 15:
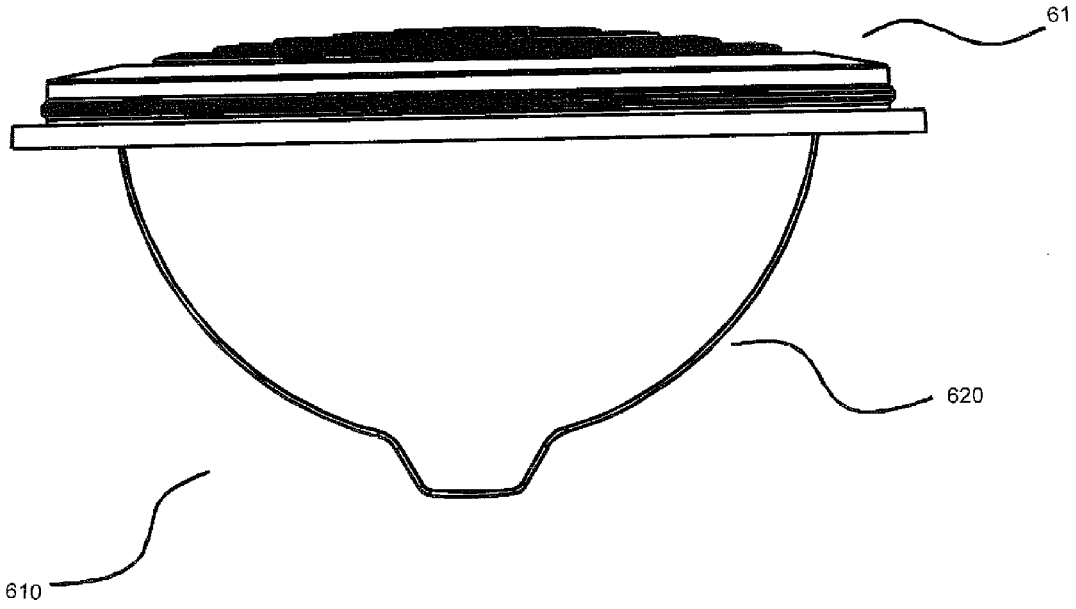
FIG. 15 is a side view of the inventive applicator.

FIG. 15 displays a side view of the living hinge applicator 610. The shape of the handle 620 can be seen from this view. The shape of the handle 620 gives the user a substantial area to grasp, giving the user a better grip while applying the deodorant.

Figure 16:
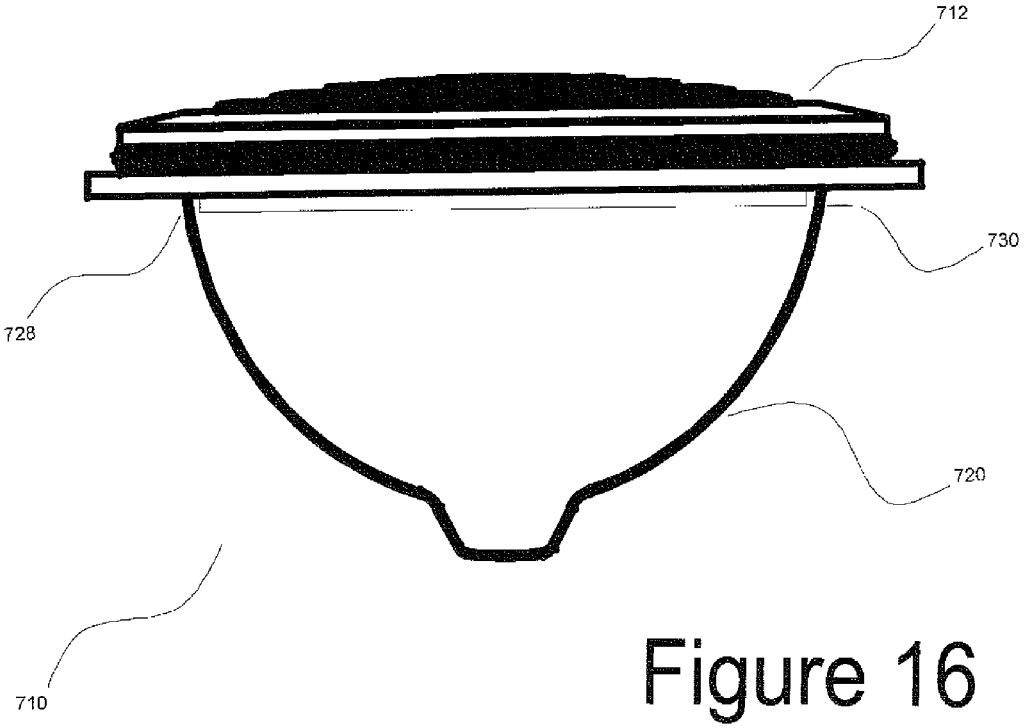
FIG. 16 is a view of an alternate living hinge embodiment of a handle of the invention with two small living hinges.

FIG. 16 displays an alternative embodiment of the inventive living hinge applicator 710. Alternative applicator 710 comprises a handle 720 and a base 712, which are substantially the same as handle 620 and base 612 of the embodiment of FIG. 13. The embodiment in FIG. 16 is essentially the same as living hinge 610 except there are two living hinges 728 and 730 which are a relatively narrow dimension. In accordance with the invention, one may have more than two living hinges.

Figure 17:
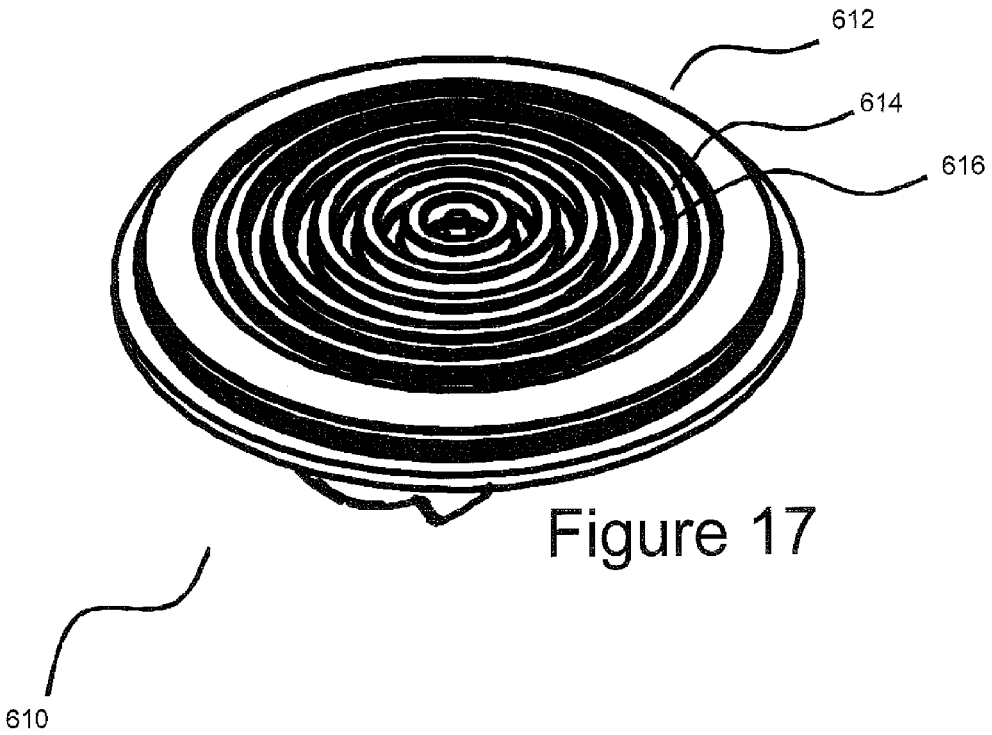
FIG. 17 is a perspective view of the inventive applicator showing the deodorant-receiving surfaces.

Returning to the embodiment of FIG. 15, FIG. 17 displays a perspective from the top of applicator 610 which is substantially the same as the top of applicator 710. This view shows the raised rings 614 and corresponding circular channels 616.

Figure 18:
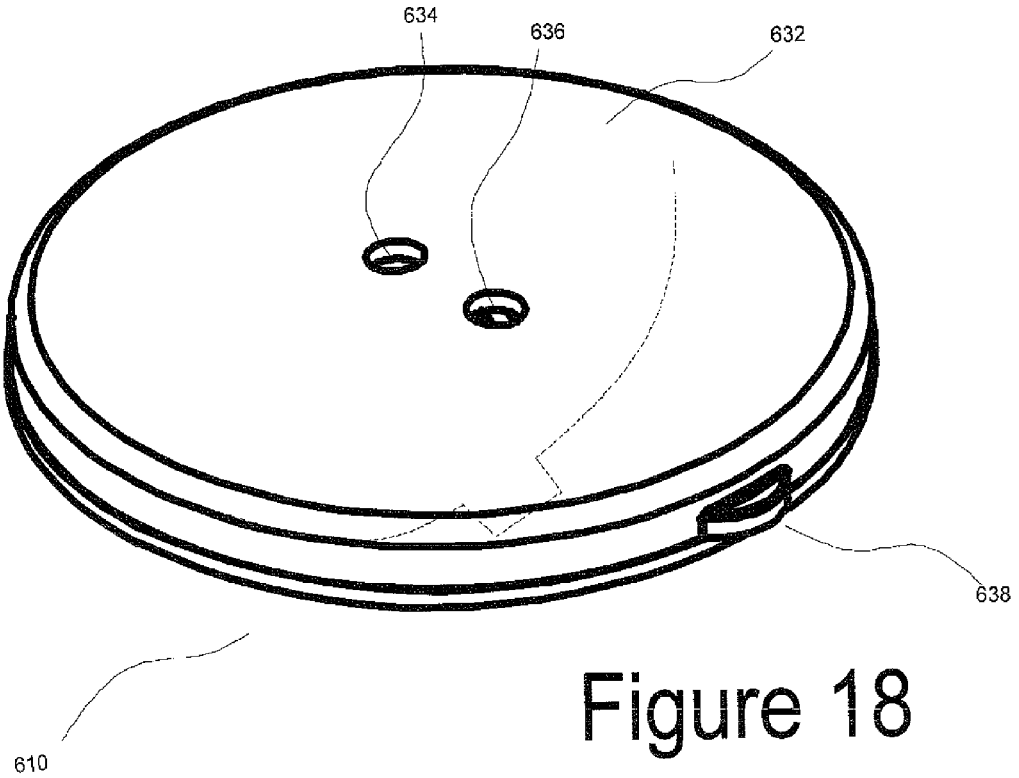
FIG. 18 is a perspective view of the inventive applicator with a cover place over the deodorant deposited on the applicator.

FIG. 18 illustrates another perspective view of applicator 610, but with a cover 632 disclose over its top surface to protect the deodorant material from being dislodged. Cover 632 is placed over base 612 (as seen in FIG. 13). Cover 632 has a protruding handle 638 which allows the user to remove cover 632 from base 612 (as seen in FIG. 13).

Cover 632 also comprises two holes 634 and 636. These holes serve a several distinct purposes. When the deodorant material is heated and in a liquid state it can be injected through holes 634 and 636 and onto the surface of deodorant applicator 610. In addition, cover 632 keeps deodorant applicator 610 substantially sealed and therefore protects the deodorant substance from dislodgement and deformation. Cover 632 holds the deodorant material in place when, after injection into covert applicator 610, it is in liquid form. This allows it to cool and harden in place over the raised rings 614 and corresponding circular channels 616. The cover 632 also protects the appearance of the product, for example in the event that the product is crushed. A sticker (not illustrated) may then be applied to cover 632 over holes 634 and 636 with a, for example, circular shape to match the cover 632 or other shape, sealing holes 634 and 636 on cover 632. Cover 632 thus provides a rigid protective member over the deodorant substance and base 612. The sticker also acts to seal the deodorant substance such that no substances can enter through the two holes 634 and 636.

The cover has a small tab 638 for the purpose of allowing one to rip cover 632 and take the cover off base 612. The base may also have a similar small tab such that the tabs can be worked against each other, aiding in the process of removing cover 632 from base 612. During manufacture, it is possible to create a specified angular orientation of one tab with respect to the other. For example, to off-set the two tabs, for example by 2-30° such that it is easy to push on one with the thumb of one hand and the other with the index finger of the same hand. Alternatively, the cover can be manufactured such that it can be rotated on the base, thus allowing the user to deviate the tabs to any angle he/she prefers.

Figure 19:
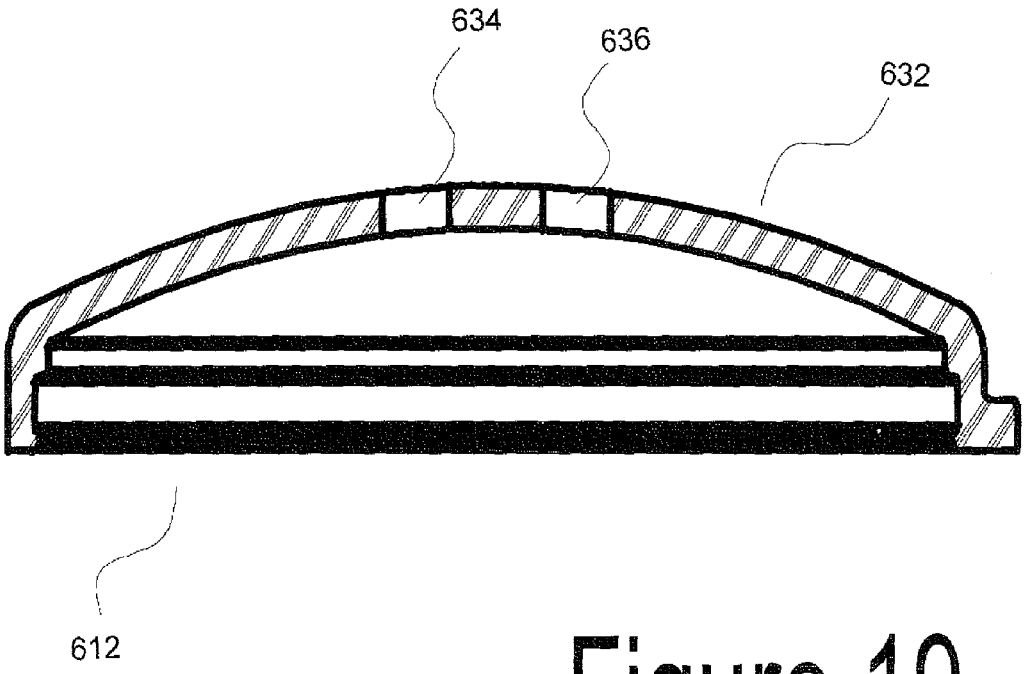
FIG. 19 is a sectional view of the cover.

FIG. 19 shows a sectional side-view of base 612 and cover 632. This view shows holes 634 and 636 passing completely through cover 632.

Figure 20:
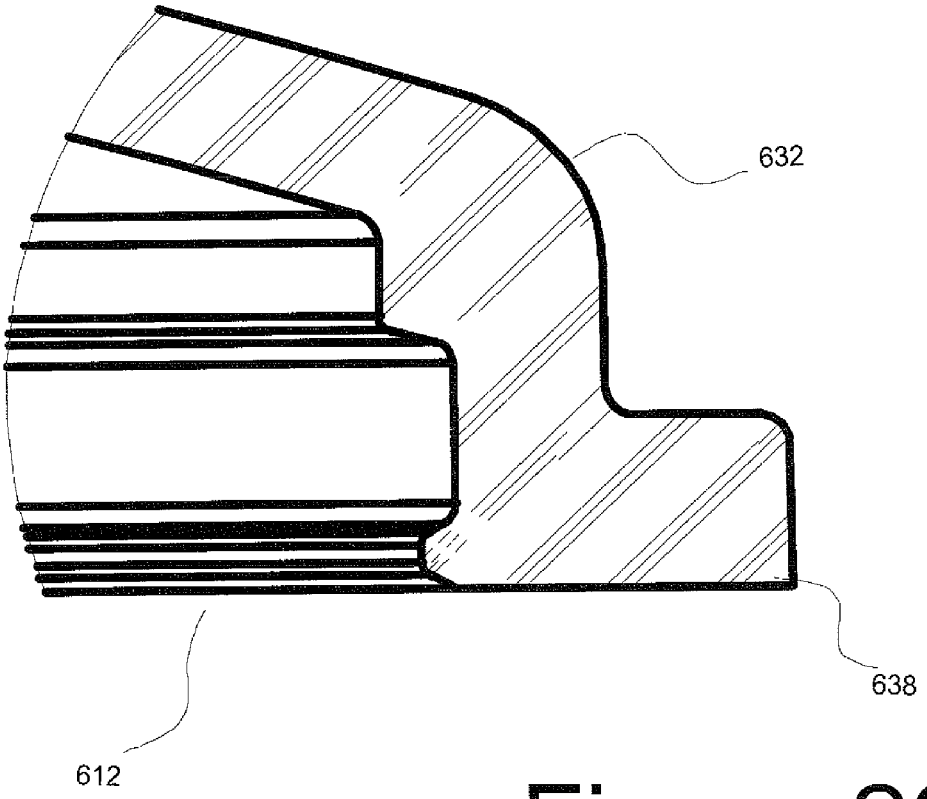
FIG. 20 is an enlarged sectional view of the cover, illustrating the edge of the base and cover.

FIG. 20 shows an enlarged sectional view of cover 632 and internal circumferential contours for receiving base 612. This view is of the region at the region of engagement between the edge of base 612 and cover 632 where protruding, handle 638 is located. Protruding handle 638 is part of cover 632. When the user lifts up protruding handle 638, protruding handle 638 and cover 632 are pulled up and away from base 612, creating space between base 612 and cover 632. This allows the cover 632 to be removed from base 612.

Figure 21:
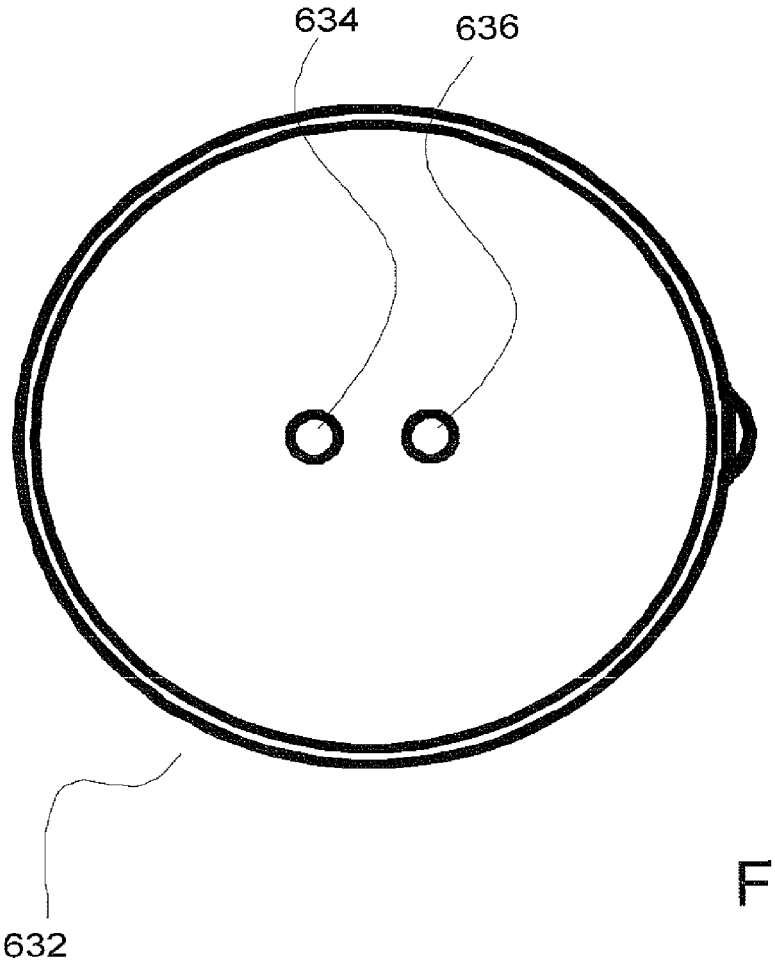
FIG. 21 is a top view of the cover.

FIG. 21 displays a top view of cover 632. This view shows the location of holes 634 and 636.

It is contemplated that the deodorant dispenser, with or without the cap, may be stored and transported in any suitable package. The package may be a ketchup-packet-type package, whereby the deodorant dispenser may be packaged in the same manner as is illustrated in FIG. 5. Alternatively, the deodorant dispenser, with or without the cap, can be included in one compartment of a two-compartment package.

In accordance with this last embodiment, the second compartment may contain a wipe, for example a conventional wipe with an alcohol-based cleaning material to allow the individual to clean him/herself before applying the deodorant. The packet may have a dimension of about 6 cm square, or perhaps slightly longer on one side and may be comprised of first, second and third heat sealable sheets, we need applicator between the first and second sheets and the wipes between the second and third heat-sealable sheets. The deodorant support may have a dimension of approximately 4.5 cm.

The manufacturing of the single-use deodorant applicator 2 is done by injecting plastic into a mold. Alternatively, the desired member ma be made by blow performing and die cutting a sheet of plastic. Multiple members may be formed simultaneously across the width of a plastic sheet web in a continuous blow forming process, thus allowing for mass production.

While the above description of the embodiments focuses on deodorant, other personal hygiene or topical products may be used as well. For example, personal hygiene or topical products such as anti-perspirants, pain-relievers such as IcyHot®, anti-chafing balm such as Glide®, etc. may be used.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. Apparatus for the application of an appliable deodorant substance to the surface of the human body comprising:

(a) a base comprising:

(i) an applicator portion comprising a matrix of recesses, said matrix of recesses defines an array of narrow elongated contours, at least some of said narrow elongated contours extending at least partially around one or more of others of said narrow elongated contours, wherein each of said narrow elongated contours defines a recess defined by facing sidewalls, said facing sidewalls extending at an angle with respect to said deodorant support surface, said facing sidewalls engaging said deodorant substance, said applicator portion having a solid deodorant support surface; and (ii) a gripping portion, said applicator portion being integrally formed with said gripping portion;

(b) a deodorant substance secured to the deodorant support surface on said applicator portion of said base, said base and deodorant substance forming an applicator; and (c) a protective member supported over said deodorant substance and protecting said deodorant substance.

2. Apparatus as in claim 1, wherein said protective member comprises a pair of facing plastic film portions, said facing plastic film portions being secured to each other to form a compartment.

3. Apparatus as in claim 2, wherein said gripping portion comprises:

(a) a handle dimensioned to be grasped between the fingers and thumb of a human hand; and (b) a mounting coupling said handle to said base and hingedly supporting said handle whereby said handle is free to move between a storage position and a gripping position.

4. An apparatus as in claim 3, wherein said mounting member is coupled to said base and said handle such that said mounting member forms a living hinge for said handle, allowing said handle to move freely between a position that is perpendicular to said base and coplanar with said base.

5. An apparatus as in claim 4, wherein said living hinge comprises:

(a) a top portion coupled to said base;

(b) a bottom portion coupled to said handle;

(c) a flexible middle portion, said flexible middle portion coupling said top portion to said bottom portion.

6. Apparatus as in claim 5, wherein said living hinge has an axis of rotation and said flexible middle portion comprises:

(a) a first surface defined on said living hinge, said first surface having a length extending transverse the axis of rotation of said living hinge, said first surface having a first width, (b) a second surface, defined on said living hinge opposite said first surface, said second surface having a length extending transverse the axis of rotation of said living hinge, said second surface having a second width, said second width being narrower than said first width.

7. Apparatus as in claim 5, wherein said flexible middle portion comprises a single continuous living hinge.

8. Apparatus as in claim 5, wherein said flexible middle portion comprises at least two separate living hinges.

9. Apparatus as in claim 3, wherein said mounting is mounted on said base by mounting pins which allow said mounting to rotate around said mounting pins in an arc.

10. Apparatus as in claim 3 wherein said applicator portion and said handle are made of plastic.

11. Apparatus as in claim 10 wherein said applicator portion and said handle are injection molded from a single piece of plastic.

12. Apparatus as in claim 3, wherein said mounting is flexible.

13. Apparatus as in claim 12, wherein said base and said handle are made of plastic.

14. Apparatus as in claim 1, wherein said deodorant substance comprises a gel or solid.

15. Apparatus as in claim 1, wherein said deodorant substance is smearable.

16. Apparatus as in claim 1, wherein said protective member completely surrounds said gripping portion, said applicator portion, and said deodorant substance.

17. Apparatus as in claim 1, wherein said protective member hermetically seals said deodorant substance from the environment.

18. Apparatus as in claim 1, wherein said gripping portion comprises a handle dimensioned to be grasped between the fingers and thumb of a human hand, said handle comprising a mounting portion which allows angular movement of said gripping portion from a first position extending from said applicator portion to a second position adjacent said applicator portion.

19. Apparatus as in claim 18, wherein said mounting structure comprises first and second parts, said first and second parts not being integral with each other.

20. Apparatus as in claim 19, wherein said first part is integral with said applicator portion and said second part is integral with said gripping portion.

21. Apparatus for the application of an appliable deodorant substance to the surface of a human body comprising:

(a) a base comprising:

(i) an applicator portion, said applicator portion having a deodorant solid support surface, and wherein said deodorant support surface of said applicator portion of said base comprises a matrix of recesses to which said deodorant substance is affixed; and (ii) a gripping portion, said applicator portion being integrally formed with said gripping portion; and (b) a deodorant substance secured to the deodorant support surface on said applicator portion of said base, said base and deodorant substance forming an applicator, wherein said matrix of recesses defines an array of narrow elongated contours, at least some of said narrow elongated contours extending at least partially around one or more of others of said narrow elongated contours wherein each of said narrow elongated contours defines a recess defined by facing sidewalls, said facing sidewalls extending at an angle with respect to said deodorant support surface, said facing sidewalls engaging said deodorant substance.

22. Apparatus for the application of an appliable personal hygiene or topical substance to the surface of the human body comprising:

(a) a base comprising:

(i) an applicator portion, said applicator portion having a solid personal hygiene or topical substance support surface; and (ii) a gripping portion, said applicator portion being integrally formed with said gripping portion;

(b) a personal hygiene or topical substance secured to the personal hygiene or topical substance support surface on said applicator portion of said base, said base and personal hygiene or topical substance forming an applicator; and (c) a protective member supported over said personal hygiene or topical substance protecting said personal hygiene or topical substance, said protective member comprising at least one hole through which said applicable personal hygiene or topical substance can be injected.

23. Apparatus as in claim 22, wherein said applicator portion of said base comprises a matrix of recesses to which said personal hygiene or topical substance is affixed.

24. Apparatus as in claim 23, wherein said matrix of recesses defines an array of narrow elongated contours, at least some of said narrow elongated contours extending at least partially around one or more of others of said narrow elongated contours, wherein each of said narrow elongated contours defines a recess defined by facing sidewalls, said facing sidewalls extending at an angle with respect to said deodorant support surface, said facing sidewalls engaging said personal hygiene or topical substance.

25. Apparatus as in claim 22, wherein said protective member comprises a pair of facing plastic film portions, said facing plastic film portions being secured to each other to form a compartment.

26. Apparatus as in claim 25, wherein said gripping portion comprises:

(a) a handle dimensioned to be grasped between the fingers and thumb of a human hand; and (b) a mounting coupling said handle to said base and hingedly supporting said handle whereby said handle is free to move between a storage position and a gripping position.

27. An apparatus as in claim 26, wherein said mounting member is coupled to said base and said handle such that said mounting member forms a living hinge for said handle, allowing said handle to move freely between a position that is perpendicular to said base and coplanar with said base.

* * * * *